US005731139A

United States Patent [19]

Nakamura et al.

[11] Patent Number: 5,731,139

[45] Date of Patent: Mar. 24, 1998

[54] SILVER HALIDE PHOTOGRAPHIC LIGHT SENSITIVE MATERIALS

[75] Inventors: Masaki Nakamura; Nobuaki Kagawa; Yoshihiko Suda, all of Hino, Japan

[73] Assignee: Konica Corporation, Tokyo, Japan

[21] Appl. No.: 612,565

[22] Filed: Mar. 8, 1996

[30] Foreign Application Priority Data

Mar. 14, 1995 [JP] Japan ..... 7-081931

[51] Int. Cl.[6] ..... G03C 1/34

[52] U.S. Cl. ..... 430/607; 430/613; 430/614; 430/615

[58] Field of Search ..... 430/607, 613, 430/614, 615

[56] References Cited

U.S. PATENT DOCUMENTS

| | | | |
|---|---|---|---|
| 4,558,003 | 12/1985 | Sagawa | 430/617 |
| 5,192,650 | 3/1993 | Seto et al. | 430/546 |

FOREIGN PATENT DOCUMENTS

| | | | |
|---|---|---|---|
| 0 164 961 | 12/1985 | European Pat. Off. | G03C 7/26 |
| 2-37340 | 2/1990 | Japan | G03C 1/06 |
| 5-249591 | 9/1993 | Japan | G03C 1/04 |

OTHER PUBLICATIONS

Patent Abstracts of Japan, vol. 014, No. 191 (1990) of JP-A-02 037340.

Derwent Publications Ltd., No. AN 93-340605 of JP-A-05 249591 (1993).

*Primary Examiner*—Mark F. Huff

*Attorney, Agent, or Firm*—Frishauf, Holtz, Goodman, Langer & Chick, P.C.

[57] ABSTRACT

A silver halide photographic light sensitive material comprises a support and provided thereon, a light sensitive silver halide emulsion layer, wherein said light sensitive silver halide emulsion layer or another layer contains an organic compound having a boron atom bonding to at least two oxygen atoms.

8 Claims, No Drawings

SILVER HALIDE PHOTOGRAPHIC LIGHT SENSITIVE MATERIALS

FIELD OF THE INVENTION

The present invention relates to a silver halide photographic light-sensitive material, and more particularly to a silver halide photographic light-sensitive material excellent in storage stability and showing minimal contamination after being subjected to photographic processing.

BACKGROUND OF THE INVENTION

The silver halide photographic light-sensitive material is superior to any other light-sensitive materials in terms of high sensitivity, high resolution and cost. However, since the silver halide photographic light-sensitive material employs chemical reaction, many chemical substances must be employed. These chemical substances require that they are fixed to an emulsion before exposure and not be allowed to move to other layers. In addition, chemical substances which adversely affect the silver halide photographic light-sensitive material after photographic processing, for example, in terms of color tone change must be employed. Such chemical substances include inhibitors, sensitizing dyes, dyes and DIR compounds.

With regard to inhibitors, they are necessarily fixed to the silver halide before exposure to maintain storage stability. However, it is also necessary, during photographic processing, to remove the inhibitors from the silver halide in order to promote photographic activity as much as necessary. As such a means therefor, water solubility is enhanced as follows; a carboxylic acid group is introduced to a mercapto tetrazole inhibitor as described in GB No. 1,275,701; and a sulfonic acid group is introduced to a mercapto tetrazole inhibitor as described in japanese Patent Publication Open to Public Inspection (hereinafter, referred to as Japanese Patent O.P.I. Publication) No. 192936/1985. However, in the case of the above-mentioned inhibitors, it is insufficient to fix them on the silver halide and it becomes necessary to add a large amount of inhibitors to maintain storage stability. Accordingly, a shortcoming of inhibited development activity results.

With regard to sensitizing dyes, it is desirable that they are fixed to silver halide before exposure, and promptly removed from the silver halide during photographic processing. When the sensitizing dye is not sufficiently removed, staining results, having adverse influence on color reproduction. As a means for solving this problem, Japanese Patent O.P.I. Publication No. 93978/1993 discloses a technology to use alkaline soluble sensitizing dyes. In addition, Japanese Patent O.P.I. Publication No. 286953/1993 discloses a technology to use a self-decoloring sensitizing dye. However, the above-mentioned sensitizing dyes have shortcomings that they are difficult to be synthesized and that their decomposed substances remain in the silver halide photographic light-sensitive material even after photographic processing, resulting in discoloration.

With regard to dyes, in the case of conventional types having a sulfonic acid group as a water soluble group, it was impossible to be fix to the silver halide because their solubility was too large. Therefore, there were shortcomings that the above-mentioned dyes stain other layers and, thereby, reduce sensitivity. In order to improve the above-mentioned shortcomings, EP No. 29945 discloses a dye wherein a carboxylic acid is incorporated in place of a sulfonic acid group. Though this dye is excellent in terms of fixing to a layer, to the contrary, it was insufficient in terms of solubility in a developing solution, causing staining. In addition, EP No. 524594 discloses a dye which is easily decomposed due to photographic processing. However, this technology also has a shortcoming that the decomposed substances remain in the silver halide photographic light-sensitive material after photographic processing, causing discoloration. In addition, Japanese Patent O.P.I. Publication No. 59391/1993 discloses a dye having a boron atom which is bound with two or more carbon atoms. However, the solubility of this dye is insufficient so that there is a problem that this dye is not sufficiently removed by being dissolved in a photographic processing solution.

With regard to DIR compounds used in the silver halide color photographic light-sensitive material, they exhibit the desirable feature that the DIR compound, which is fixed to the silver halide during exposure, immediately releases an inhibitor during photographic processing and that the released inhibitor is appropriately diffused to effect inhibition phenomenon. However, DIR compounds disclosed in Japanese Patent O.P.I. Publication Nos. 151944/1982, 205150/1983, 221750/1985 and 11743/1986 and U.S. Pat. No. 4,782,012 were insufficient in terms of increased fogging and deteriorated sensitivity, sharpness and color reproducibility during storage.

Recently, on the other hand, photographic processing time has decreased, and waterless washing and recycling of the processing solution have been adopted. Accordingly, the chemical compounds as above which have an adverse affect on photographic properties are likely to remain. Therefore, removal of these chemical compounds has become an important issue.

SUMMARY OF THE INVENTION

Accordingly, an objective of the present invention is to overcome the above-mentioned problems and to provide a silver halide photographic light-sensitive material providing excellent storage stability and lessened staining after photographic processing, especially a silver halide photographic light-sensitive material wherein fogging is minimized while sensitivity is not lowered and fluctuations of photographic performance due to long-term storage is minimized.

DETAILED DESCRIPTION OF THE INVENTION

The above object of the invention can be attained by a silver halide photographic light sensitive material comprising a support and provided thereon, at least one light sensitive silver halide emulsion layer, wherein the material contains an organic compound (hereinafter referred to as the organic compound of the invention) having a boron atom bonding to at least two oxygen atoms.

The above object can be effectively attained when the organic compound of the invention is a compound represented by the following formula (1):

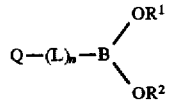

formula (1)

wherein Q represents an organic heterocyclic group containing a nitrogen atom; L represents a divalent group; $R^1$ represents a hydrogen atom or a cation; $R^2$ represents a hydrogen atom, a cation or a substituent; and n is an integer of 0 or 1.

The above object can be most effectively attained when said Q in formula (1) has a mercapto group or its salt group as a substituent.

The invention will be detailed below.

The organic compound of the invention may have any compound having a boron atom bonding to at least two oxygen atoms, and includes an organic boronic acid compound and an organic boric acid compound. The compound represented by formula (1) is preferable since the invention is effectively attained.

The compound represented by formula (1) will be detailed below.

Q in formula (1) represents an organic heterocyclic group containing a nitrogen atom. The preferable heterocyclic group includes an imidazole ring, a pyrazole ring, a triazole ring, a tetrazole ring, an oxazole ring, a thiazole ring, a selenazole ring, a tellurazole ring, an oxadiazole ring, a thiadizole ring, a pyridine ring, a pyrazine ring, and pyrimidine ring and a condensed ring such as a benzimidazole ring, a benzotriazole ring, a benzoxazole ring, a benzothiazole ring or a tetrazaindene ring.

The preferable Q is an imidazole ring, a triazole ring or a tetrazole ring.

L represents a divalent group, and the preferable includes an alkylene group, an arylene group, an aromatic heterocyclic group, an ether group —O—, a thioether group —S—, an imino group —NH—, an ester group —COO—, a carbonylamino group and a sulfonyl group, and a combination thereof.

The preferable L is an arylene ring.

The cation represented by $R^1$ or $R^2$ includes an inorganic cation such as a sodium, potassium, calcium or ammonium ion and an organic cation such as a trimethylammonium or pyridinium ion. In the invention a monovalent cation is used, or a cation corresponding to a monovalent cation is also used, that is, a ½ calcium ion is used in the case of a calcium ion.

The substituent represented by $R^2$ includes an alkyl group, an alkenyl group, an alkinyl group, an aryl group, a heterocyclic group, an acyl group, a sulfonyl group, an alkoxy group and an aryloxycarbonyl group.

The alkyl group includes a methyl, trifluoromethyl, benzyl, chloromethyl, dimethylaminomethyl, ethoxycarbonyl methyl, aminomethyl, acetylmethyl, ethyl, carboxyethyl, n-propyl, t-butyl, n-pentyl, cyclopentyl, n-hexyl, cyclohexyl, n-octyl, n-decyl and n-undecyl group.

The alkenyl group includes a vinyl, allyl, 2-chlorovinyl, 1-methylvinyl, 2-cyanovinyl and cyclohexene-1-yl group.

The alkinyl group includes an ethinyl, 1-propinyl and 2-ethoxycarbonylethinyl group.

The aryl group includes a phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-methylsulfonylphenyl, and 2,4-dimethylphenyl group.

The heterocyclic group includes a 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzoimidazolyl, 2-benzoxazolyl, 2-oxazoline-2-yl, and morpholino group.

The acyl group includes an acetyl, propionyl, isobutyroyl, 2,2-dimethylpropionyl, benzoyl, 3,4-dichlorobenzoyl, 3-acetylamino-4-methoxybenzoyl and 4-methylbenzoyl group.

The sulfonyl group includes a methylsulfonyl, ethylsulfonyl, chloromethylsulfonyl, propylsulfonyl, butylsulfonyl, n-octylsulfonyl, phenylsulfonyl, and p-toluenesulfonyl group.

The alkoxycarbonyl group includes a methoxycarbonyl, ethoxycarbonyl, t-butoxycarbonyl, 2-phenylsulfonylethoxycarbonyl, and benzyloxycarbonyl group.

The aryloxycarbonyl group includes a phenoxycarbonyl, 3-cyanophenoxycarbonyl, 4-acetoxyphenoxycarbonyl, and 4-t-butoxycarbonylaminophenoxycarbonyl group.

The preferable $R^2$ is a hydrogen atom, a sodium cation or a potassium cation.

The organic heterocyclic group by Q or the divalent group by L may have a substituent and the substituent includes the following groups.

Examples of the substituent are as follows:

a nitro, nitroso, cyano, carboxy, sulfo, mercapto, hydroxy, halogen, alkyl, alkenyl, alkinyl, aryl, heterocyclic, acyl, sulfonyl, amino, alkoxy, aryloxy, heteroaryl, alkylthio, arylthio, heteroarylthio, ammonio, carbamoyl, sulfamoyl, acylamino, acyloxy, sulfonylamino, alkoxycarbonylamino, aryloxycarbonylamino, alkoxycarbonyloxy, aryloxycarbonyloxy, aminocarbonylamino, aminocarbonylamino, aminosulfoylamino, sulfonyloy, alkoxycarbonyl and aryloxycarbonyl group.

The halogen includes a fluorine, chlorine, bromine, and iodine atom.

The alkyl group includes a methyl, trifluoromethyl, benzyl, chloromethyl, dimethylaminomethyl, ethoxycarbonyl methyl, aminomethyl, acetylmethyl, ethyl, carboxyethyl, n-propyl, t-butyl, n-pentyl, cyclopentyl, n-hexyl, cyclohexyl, n-octyl, n-decyl and n-undecyl group.

The alkenyl group includes a vinyl, 2-chlorovinyl, 1-methylvinyl, 2-cyanovinyl and cyclohexene-1-yl group.

The alkenyl group includes a vinyl, 2-chlorovinyl, 1-methylvinyl, 2-cyanovinyl and cyclohexene-1-yl group.

The alkynyl group includes an ethinyl, 1-propinyl and 2-ethoxycarbonylethinyl group.

The aryl group includes a phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-methylsulfonylphenyl, and 2,4-dimethylphenyl group.

The heterocyclic ring group includes a 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzoimidazoyl, 2-benzoxazolyl, 2-oxazoline-2-yl, and morpholino group.

The acyl group includes an acetyl, propionyl, isobutyroyl, 2,2-dimethylpropionyl, benzoyl, 3,4-dichlorobenzoyl, 3-acetylamino-4-methoxybenzoyl and 4-methylbenzoyl group.

The sulfonyl group includes a methylsulfonyl, ethylsulfonyl, chloromethylsulfonyl, propylsulfonyl, butylsulfonyl, n-octylsulfonyl, phenylsulfonyl, and p-toluenesulfonyl group.

The amino group includes a amino, methylamino, dimethylamino, ethylamino, ethyl-3-carboxypropylamino, ethyl-2-sulfoethylamino, phenylamino, methylphenylamino, and methyloctylamino group.

The alkoxy group includes a methoxy, ethoxy, n-propyloxy, and cyclohexylmethoxyoxy group.

The aryloxy or aromatic heterocyclicoxy group includes a phenoxy, naphtyloxy, 4-acetylaminophenoxy, and pyridine-2-yloxy group.

The alkylthio group includes a methylthio, ethylthio, n-butylthio, n-octylthio, t-octylthio, ethoxycarbonylmethylthio, benzylthio, and 2-hdroxyethylthio group.

The arylthio or aromatic heterocyclicthio group includes a phenylthio, 4-chlorophenylthio, 2-n-butoxy-5-t-octylphenylthio, 4-nitrophenylthio, 2-nitrophenylthio, 4-acetylaminophenylthio, 1-phenyl-5-tetrazolylthio, and 5-methylsulfonylbenzothiazole-2-yl group.

The ammonio group includes an ammonio, trimethylammonio, phenyldimethylammonio, and dimethylbenzylammonio group.

The carbamoyl group includes a carbamoyl, methylcarbamoyl, dimethylcarbamoyl, bis-(2-metoxyethyl) carbamoyl, and cyclohexylcarbamoyl group.

The sulfamoyl group includes a sulfamoyl, methylsulfalmoyl, dimethylsulfamoyl, bis-(2-metoxyethyl) sulfamoyl, and di-n-butylsulfamoyl group.

The acylamino group includes an acetylamino, 2-carboxybenzoylamino, 3-nitrobenzoylamino, 3-diethylaminopropanoylamino, and acryloylamino group.

The acyloxy group includes an acetoxy, benzoyloxy, 2-butenoyloxy, and 2-methylpropanoyloxy group.

The sulfonylamino group includes a methanesulfonylamino, phenylsulfonylamino, and 2-methoxy5-n-methyl phenyl-sulfonylamino group.

The alkoxycarbonylamino group includes a methoxycarbonylamino, 2-methoxyethoxycarbonylamino, iso-butoxycarbonylamino, benzyloxycarbonylamino, t-butoxycarbonylamino, and 2-cyanoethoxycarbonyamino group.

The aryloxycarbonylamino group includes a phenoxycarbonylamino, and 2,4-nitrophenoxycarbonylamino group.

The alkoxycarbonyloxy group includes a methoxycarbonyloxy, t-butoxycarbonytoxy, 2-phenylsulfonylethoxycarbonyloxy, and benzylcarbonyloxy group.

The aryloxycarbonyloxy group includes a phenoxycarbonyloxy, 3-cyanophenoxycarbonyloxy, 4-acetoxyphenoxycarbonyloxy, and 4-t-butoxycarbonylaminophenoxycarbonyloxy group.

The aminocarbonylamino group includes a methylaminocarbonylamino, morpholinocarbonylamino, N-ethyl-N-phenylaminocarbonylamino, and 4-methylsulfonylaminocarbonylamino group.

The aminocarbonyloxy group includes a dimethylaminocarbonyloxy, pyrrolidinocarbonyloxy, and 4-dipropylaminocarbonyloxy group.

The aminosulfonylamino group includes a diethylaminosulfonylamino, di-N-butylaminosulfonylamino, and phenylaminosulfonylamino group.

The sulfonyloxy group includes a phenylsulfonyloxy, methylsulfonyloxy, chloromethylsulfonyloxy, and 4-chloropentylsulfonyloxy group.

The alkoxycarbonyl or aryloxycarbonyl group includes a methoxycarbonyl, ethoxycarbonyl, phenoxycarbonyl, and 2-methoxyethoxycarbonyl group.

The examples of the organic compound of the invention will be shown below, but the compounds are not limited thereto.

1

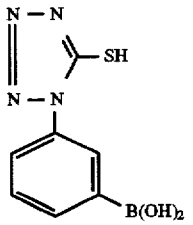

-continued

2

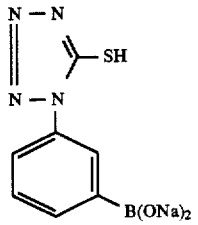

3

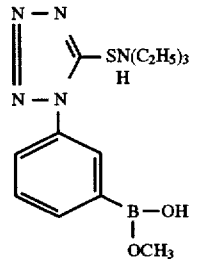

4

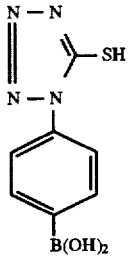

5

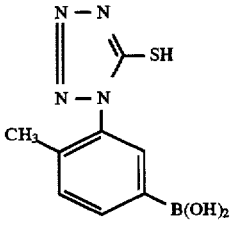

6

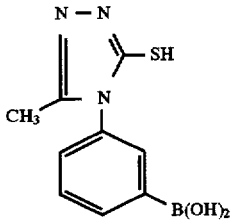

7

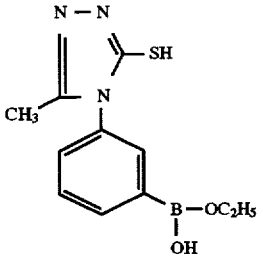

-continued
8
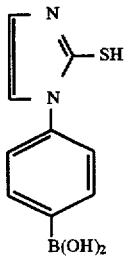
9
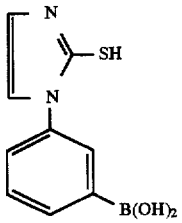
10
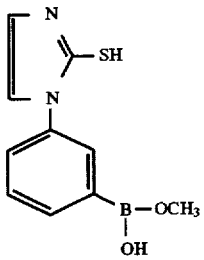
11
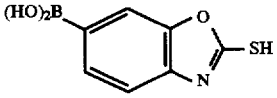
12
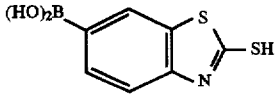
13
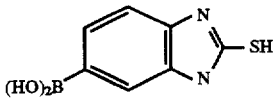
14
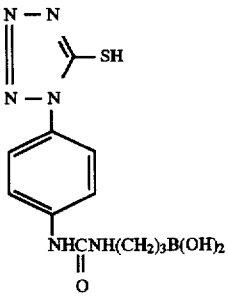
-continued
15
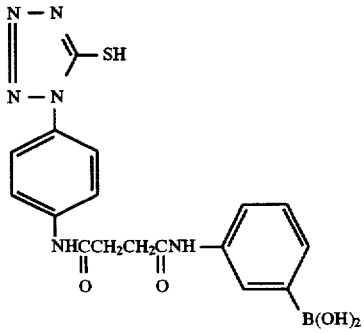
16
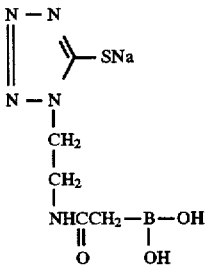
17
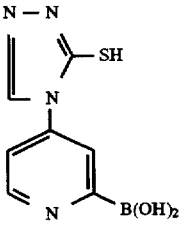
18
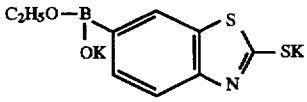
19
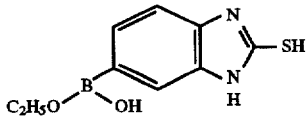
20
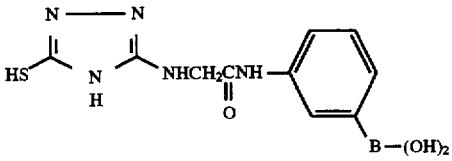
21
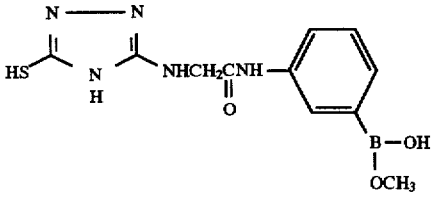

-continued

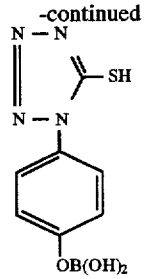

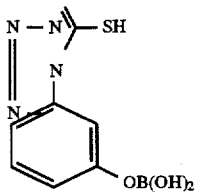

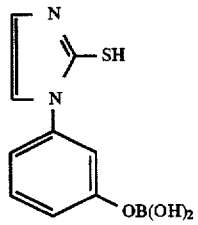

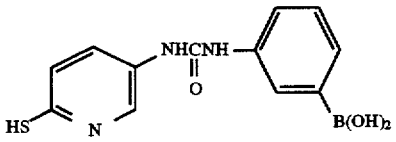

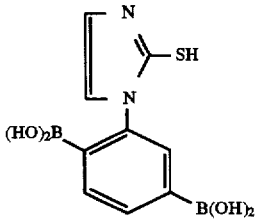

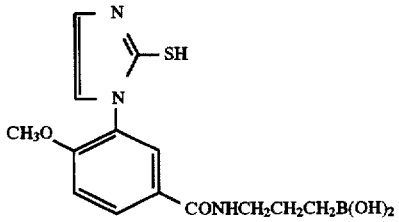

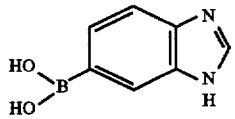

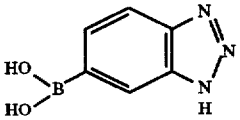

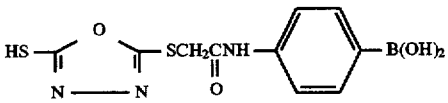

-continued

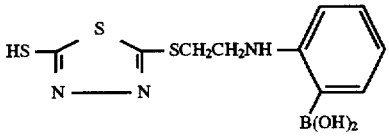

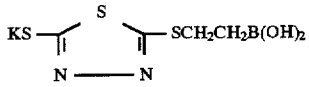

Synyhetic example of Exemplified compound 1

In a solution containing 0.2 g (5 mmol) of sodium hydroxide and 3 ml of water were dissolved 72 g (5 mmol) of 3-aminophenyl (boronic acid), and cooled with ice. The resulting solution was added with 0.38 ml (5 mmol) of thiophosgen at not more than 5° C. and stirred. After 10 minutes, yellow precipitate was filtered out, and the precipitate is added to a solution in which 1.3 g of sodium azide is dissolved in 3 ml water and refluxed for 5 hours. The resulting solution was cooled, and filtered out to obtain filtrate. The filtrate was acidified with concentrated hydrochloric acid to produce white precipitate. The precipitate was filtered out to obtain 0.53 g of 3-(5-mercaptotetrazol-1-yl)phenyl (boronic acid). The product was recrystallized from a mixture solvent of water and ethanol to obtain 0.14 g of colorless needle crystal. Melting point:more than 270° C., Anion FAB-MS /matrix-glycerin) m/e 193(M+Gly–$2H_2O$)

The other exemplified compounds are synthesized in the same manner as above.

A compound represented by Formula (1) may be added to a silver halide emulsion layer or another hydrophilic colloid layer (an intermediate layer, a surface protection layer, a yellow filter layer or an anti-halation layer) in a photographic light-sensitive material. Preferably, the compound is added to a silver halide emulsion layer.

The added amount of the compound represented by Formula (1) is preferably $1\times10^{-5}$ to $1\times10^{-1}$ g/m$^2$, more preferably $5\times10^{-5}$ to $5\times10_{-2}$ g/m$^2$ and most preferably $1\times10^{-4}$ to $1\times10^{-2}$ g/m$^2$.

As an addition method of the compound represented by Formula (1) to the silver halide emulsion, any conventional addition method of an additive to the silver halide emulsion may be acceptable. For example, the compound is dissolved in methanol, ethanol, methylcellosolve, acetone, water or a mixed solutions thereof, and added in the form of a mixture. In addition, the compound may be added as a dispersed solution prepared by means of a solid dispersion, an emulsifying dispersion, a supersonic dispersion and an oil-protected dispersion.

Compounds represented by Formula (1) may be added at any step of the silver halide emulsion production. It may also be added at any step after the emulsion is produced, up to immediately before coating. In the present invention, the addition step is preferably between the end of the silver halide grain forming step and the completion of the coating solution preparation step.

For chemical ripening of the silver halide emulsion used in the present invention, chemical sensitizers such as a sulfur sensitizer, a gold sensitizer, a selenium sensitizer and a tellurium sensitizer may be used. In addition, reduction sensitizers may also be employed.

A halogen composition of the silver halide emulsions used in the present invention is arbitrary and may be such as silver bromide, silver bromoiodide, silver chloride, silver bromochloride, silver bromoiodochloride or silver iodochloride. These composition can be prepared by methods described in Shimmy et Physique Photographic written by P. Graphkidess (published by Paul Montel, 1967), Photographic Emulsion Chemistry written by G. F. Duffin (published by The Focal Press, 1966), Making and Coating Photographic Emulsion written by V. L. Jerikman and others (published by The Focal Press, 1964), Japanese Patent O.P.I. Publication Nos. 39027/1976, 48521/1979, 142329/1980, 13928/1983 and 138538/1985 and Japan Photographic Academy 1983 Annual Congress Summary, page 88.

Namely, any of an acid method, a neutral method and an ammonia method may be used. In addition, as a method to react soluble silver salt and soluble halogen salt, any of a one-side mixing method, a double ject method a mixing method thereof wherein grains are formed in presence of excessive silver ions (a reverse mixing method) and a method to supply soluble silver salt and soluble halogen salt to fine seed crystals for growing may be used. In addition, two or more silver halide emulsion may be combined.

A hydrophilic protective colloid used for preparing the silver halide photographic light-sensitive material of the present invention includes gelatin derivatives such as acetylated gelatin and phthalated gelatin, water-soluble cellulose derivatives and other synthetic or natural hydrophilic polymers, in addition to gelatin for conventional silver halide emulsions as described in Product Licensing index, Volume 92 on page 108 "Vehicle".

To the silver halide photographic light-sensitive material of the present invention, conventional technologies and additives can be added as necessary. For example, in addition to light-sensitive silver halide emulsion layer, auxiliary layers such as protective layers, filter layers, anti-halation layers, cross-over light cutting layers and backing layers may be provided. In the above-mentioned layers, various chemical sensitizers, noble metal sensitizers, light-sensitive dyes, super sensitizers, couplers, high boiling solvents, bleaching accelerators, fixing accelerators, anti-staining agents, formalin scavengers, color tone agents, hardeners, surfactants, viscosity raising agents, plasticizers, lubricants, UV absorbers, anti-irradiation dyes, filter light absorption dyes, anti-mildew agents, polymer latexes, heavy metals, anti-static agents and matting agents can be added by various method. In addition, anti-foggants and development inhibitors can also be added in addition to the organic compounds of the present invention.

The above-mentioned additives are described in detail in Research Disclosure (hereinafter, abbreviated as "RD") Volume 176, Item/17643 (December, 1978), RD Volume 184, item/18431 (August, 1979), RD Volume 187, item/18716 November, 1979) and RD Volume 308, item/308119 (December, 1989).

The kinds of compounds illustrated in the above-mentioned RD-17643, 18716 and 308119 and their description points are described as follows:

| | (RD-17643) | | (RD-18716) | (RD-303119) | |
|---|---|---|---|---|---|
| | Page | Category | Page | Page | Category |
| Chemical sensitizer | 23 right | III | 648 upper | 996 | III |
| Sensitizing dye | 23 | IV | 648–649 | 996–998 | IV |
| Desensitizing dye | 23 | IV | | 998 | IV |
| Dye | 25–26 | VIII | 649–650 | 1003 | VIII |
| Development accelerator | 29 | XXI | 648 upper right | | |
| Anti-foggant, Development inhibitor | 24 | IV | 649 upper right | 1006–1007 | VI |
| Brightening agent | 24 | V | | 998 | V |
| Hardener | 26 | X | 651 left | 1004–1005 | X |
| Surfactant | 26–27 | XI | 650 right | 1005–1006 | XI |
| Anti-static agent | 27 | XII | 650 right | 1006–1007 | XIII |
| Plasticizer | 27 | XII | 650 right | 1006 | XII |
| Lubricant | 27 | XII | | | |
| Matting agent | 28 | XVI | 650 right | 1008–1009 | XVI |
| Binder | 26 | XXII | | 1003–1004 | IX |
| Support | 28 | XVII | | 1009 | XVII |

As a support usable for the silver halide photographic light-sensitive material of the present invenion, those described in the above-mentioned RD-17643, on page 28, RD-308119, on page 1009 and Product Licensing Index, Volume 92, on page 108, Item "Support" are cited.

As a preferable support, polyester cellulose triacetate, cellulose nitrate, polyethylene terephthalate and polyethylene-2,6-naphthalate, polyolefine such as polyethylene, polystyrene, baryta paper, paper wherein polyethylene is laminated, glass and metal are cited.

In order to improve adhesion of the coating layer, the surface of the support may be provided with subbing processing such as corona discharge processing, UV ray irradiation and provision of a subbing polymer adhesive layer.

The silver halide photographic light-sensitive material of the present invention may be any silver halide photographic light-sensitive material as long as it includes the above-mentioned light-sensitive silver halide emulsion. For example, black-and-white silver halide photographic light-sensitive materials (such as a medical light-sensitive material, a graphic arts light-sensitive material, a microfilm light-sensitive material and a negative film light-sensitive material for amateur use), color photographic light-sensitive materials (such as a color negative light-sensitive material, a color reversal light-sensitive material and a color print light-sensitive material), diffusion transfer light-sensitive materials and thermal development light-sensitive materials may be used.

When the silver halide photographic light-sensitive material of the present invention is subjected to photographic processing, developing agents described in "Product Licensing index", Volume 92, on page 110, Item "Process", "The Theory of the Photographic Process", fourth Edition, pp 291 to 334 and "Journal of the American Chemical Society", Volume 73, on page 3100 (1951) can be preferable.

[EFFECTS]

The present inventors discovered that, when an organic compound having a boron atom which is bound with at least 2 oxygen atoms has a pKa value between the pH of the photographic emulsion and the pH of the developing solution, the organic compound has the characteristic that the solubility in the photographic emulsion and the solubility in the developing solution are noticeably different, which provides desirable effect for attaining the objectives of the present invention, namely, a silver halide photograpic light-sensitive material providing lessened fogging without degrading sensitivity and in which fluctuation of photographic performance following passage of time can be provided due to a silver halide photographic light-sensitive material comprising a support provided thereon with at least one light-sensitive silver halide emulsion layer, wherein at least one kind of organic compound having a boron atom which bonds with at least two oxygen atoms.

The invention will be detailed according to the following examples, but is not Example limited thereto.

EXAMPLE 1

Preparation of seed emulsion 1

The seed emulsion 1 was prepared by the following method.

(Solution A 1)

Ossein gelatin
24.2 g

Water
9657 ml

Polypropyleneoxy-polyethyleneoxy-disuccinate sodium salt
(10% ethanol solution)
6.78 ml Potassium bromide
10.8 g 10% nitric acid
114 ml (Solution B 1)

Aqueous 2.5N $AgNO_3$ solution
2825 m (Solution C 1)

Potassium bromide
841 g

Water was added to make 2825 ml.

(Solution D 1)

Aqueous 1.75N KBr solution
an amount for controlling the following silver potential By the use of a mixing stirrer described in Japanese Patent Publication Nos. 58288/1983 and 58289/1982, 464.3 ml of each of Solution B 1 and Solution C 1 were added to Solution A in 1.5 minutes at not more than 42° C. by a double-jet method to form a nuclei.

After addition of Solutions B 1 and C 1 was stopped, the temperature of Solution A 1 was elevated to 60° C. spending 60 minutes and adjusted to pH 5.0 using a 3% KOH solution. Then, solutions B 1 and C-1 each were added by means of a double jet method for 42 minutes at a flow rate of 55.4 ml/min. The silver potentials (measured by means of a silver ion selecting electrode and a saturated silver-silver chloride reference electrode) during the temperature elevation from 42° to 60° C. and during the re-addition of solutions B-1 and C-1 were regulated to +8 mv and 16 mv, respectively, using Solution D 1.

After the addition, pH was regulated to 6 with 3% KOH. immediately after that, it was subjected to desalting and washing.

It was observed by an electron microscope that this seed emulsion was composed of hexahedral tabular grains, in which 90% or more of the total projected area of silver halide grains have a maximum adjacent side ratio of 1.0 to 2.0, having an average thickness of 0.064 μm, an average diameter (converted to a circle) of 0.595 μm. The deviation coefficient of the thickness is 40%, and the deviation coefficient of the distance between the twin planes is 42%.

(Preparation of Emulsion Em-1)

The tabular silver halide emulsion Em-1 was prepared using the seed emulsion 1 and the following four kinds of solutions.

(Solution A 2)

Ossein gelatin
24.2 g

Polypropyleneoxy-polyethyleneoxy-disuccinate sodium salt
(10% ethanol solution)
2.25 ml Seed emulsion 1
equivalent to 1.218 mol silver halide Water was added to make 3150 ml.

(Solution B 2)

Potassium bromide
1734 g

Water was added to make 3644 ml.

(Solution C 2)

Silver nitrate
2478 g

Water was added to make 4165 ml.

(Solution D 2)

Fine gain emulsion composed of 3 weight % gelatin and silver iodide grains (average grain size of 0.05 μ) equivalent to 0.08 mol silver iodide Preparation of fine gain emulsion Two liters of each of a 7.06 mol $AgNO_3$ solution and a 7.06 mol KI solution was added in 10 minutes to 6.64 liter of a 5.0 weight % gelatin solution containing 0.06 mol of KI. During the fine grain formation, the pH was adjusted to 2.0 using nitric acid, and the temperature was 40° C. After the grain formation the pH was adjusted to 6.0 using a sodium carbonate solution.

A portion of Solution B 2 , a portion of Solution C 2 and a half of Solution D 2 were added to Solution A 2 in 5 minutes at 60° C. by a triple-jet method with vigorous stirring.

Thereafter, a half of each of the remaining solutions B 2 and C 2 was added in 37 minutes, then, a portion of the remaining solutions B 2 and C 2 and the remaining solution D2 were added in 15 minutes, and finally, all of the remaining solutions B 2 and C 2 were added in 33 minutes. During this process, pH was maintained 5.8, and pAg 8.8. Herein, the addition rate of solutions B 2 and C 2 was varied as a function of time to meet a critical grain growing rate.

Further, Solution D 2 was added in an amount of 0.15 mol % of the total silver content to substitute a halogenide.

After the addition, the resulting emulsion was cooled to 40° C., added with 1800 ml of an aqueous 13.8 weight % solution of modified gelatin as a polymer coagulant, which was modified with phenylcarbamoyl (substitution rate of 90%), and stirred for 3 minutes. Thereafter, a 56 weight % acetic acid solution was added to give a pH of 4.6, stirred for 3 minutes, allowed to stand for 20 minutes, and then the supernant was decanted. Thereafter, 9.0 liter of 40° C. distilled water were added, stirred, allowed to stand, and the supernant was decanted. To the resulting emulsion were added 11.25 liter of distilled water, stirred, allowed to stand, and the supernant was decanted. An aqueous gelatin solution and a 10 weight % sodium carbonate solution were added to the resulting emulsion to be pH of 5.8, and stirred at 50° C. for 30 minutes to redisperse. After the redispersion, the emulsion was adjusted to give pH of 5.80 and pAg of 8.06.

When the resulting emulsion was observed by means of an electron microscope, they were tabular silver halide grains having an average diameter of 1.11 μm, an average thickness of 0.25 μm, an average aspect ratio of about 4.5 and a grain size distribution breadth of 18.1%. The average distance between the twin planes was 0.020 μm, and the grains having 5 or more of a ratio of the thickness to the distance was 97% (in number), the grains having 10 or more of the ratio 49%, and the grains having 15 or more of the ratio 17%.

After the resulting emulsion (Em-1) was raised to 60° C., a sensitizing dye was added in a given amount, and then a mixture solution of adenine, ammonium thiocyanate, chloroauric acid and sodium thiosulfate and a dispersion of triphenylphosphin selenide were added. Sixty minutes after the addition, the fine grain silver iodide emulsion was added, and the emulsion was ripened for total 2 hours. After completion of the ripening, Stabilizer (ST-1) was added in a given amount.

The addition amount per mol of AgX of the above additives is shown as follows.

Sensitizing dye (SD-1)
2.0 mg

Sensitizing dye (SD-2)
120 mg

Adenine
15 mg

Ammonium thiocyanide
95 mg

Chloroauric acid
2.5 mg

Sodium thiosulfate
2.0 mg

Silver iodide fine grain emulsion
280 mg

Stabilizer (ST-1)
500 mg

The silver halide grains contained in the above obtained silver halide emulsion (Em-1) had an average silver iodide content of 4 mol % on its surface. To the thus sensitized emulsion were added the following additives to obtain an emulsion layer coating solution. Further, a protective layer coating solution was prepared.

(Preparation of a silver halide photographic light sensitive material)

The above obtained emulsion layer coating solution and the following protective layer coating solution were double layer coated in that order on each side of a blue colored 175 μm thick polyethylene terephthalate film support (a density of 0.15) coated with the following light shielding layer on each side and dried. Thus, silver halide photographic light-sensitive material sample Nos. 1 through 19 were prepared.

The coating amount of silver halide and colloidal silver was represented in terms of metal silver (mg/m$^2$), and the coating amount of gelatin or other additives was represented in terms of (mg/m$^2$).

(Constitution of photographic component layers

First Layer (Light Shielding Layer)

Solid dye fine particle dispersion (AH)
180

Gelatin
0.2

Sodium dodecylbenzene sulfonate
5

Surfactant (SA-1)
5

Hardener (H-1)
5

Colloidal Silica (average diameter 0.014 μm)
10

Second Layer (Emulsion Layer)

Emulsion Em-1 obtained above was added with the following additives. Further, Emulsion Em-1 was added with 5 mg/m$^2$ or 10 mg/m$^2$ of the organic compound of the invention.

Compound (G-1)
0.5

2,6-Bis(hydroxyamino)-4-diethylamino-1,3,5-triazine
5 t-Butyl-catechol
130

Stabilizer (ST-2) (weight average molecular weight of 100,000)
35

Styrene-maleic acid anhydride copolymer
80

Poly(sodium styrenesulfonate)
80

Trimethylopropane
350

Diethylene glycol
50

Nitrophenyl-triphenyl phosphonium chloride
20

Ammonium 1,3-dihydroxybenzene-4-sulfonic acid

Additive (G-2)
0.5 n-$C_4H_9OCH_2CH(OH)CH_2N(CH_2COOH)_2$
350

Colloidal Silica
500

Latex (L)
200

Dextrin (average molecular weight 1000)
200

Gelatin
1.0

Third Layer (Protective Layer) Gelatin 800

Polymethylmethacrylate matting agent having an area average grain size of 7.0 μm) 50

Formaldehyde
20

Hardener (H-1) 10

Bis-vinylsulfonylmethyl ether
36

Latex (L)
200

Polyacrylamide (molecular weight 10,000)
100

Polysodium acrylate
30

Polysiloxane (molecular weight 70,000) 20

Surfactant (SA-1)
12

Surfactant (SA-2)
2

Surfactant (SA-3)
7

Surfactant (SA-4)
15

Surfactant (SA-5)
50

Surfactant (SA-6)

5

$C_9H_{19}—O—(CH_2CH_2O)_{11}—H$ 3.0

$C_8F_{17}SO_2N(C_3H_7)(CH_2CH_2O)_{15}H$

SD-1

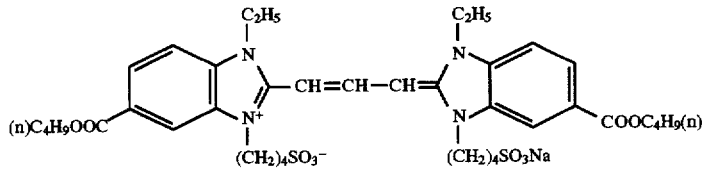

SD-2

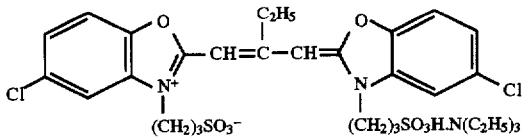

H-1

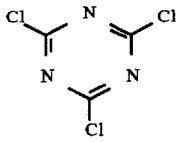

ST-1

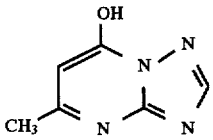

ST-2

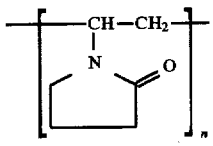

G-1

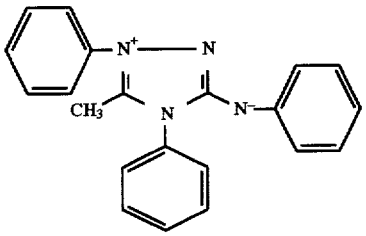

G-2

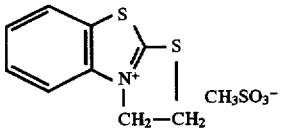

SA-1

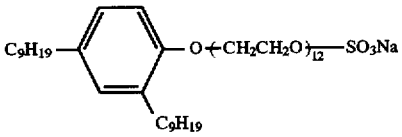

SA-2

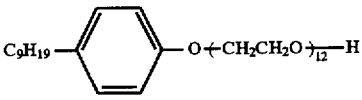

SA-3

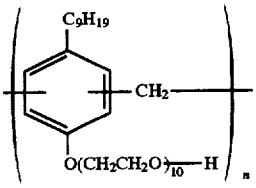

(n = mixture of 2–5)

SA-4

$C_{11}H_{23}CONH(CH_2CH_2O)_5H$

SA-5

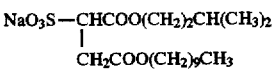

SA-6

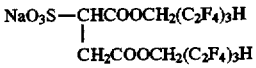

Latex (L)

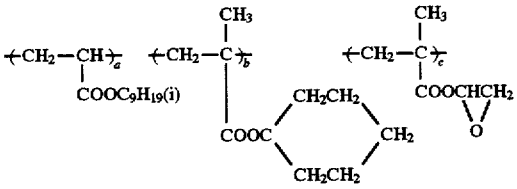

a:b:c = 30:60:10 (Formulation mol ratio)

Solid fine particle dispersion dye (AH)

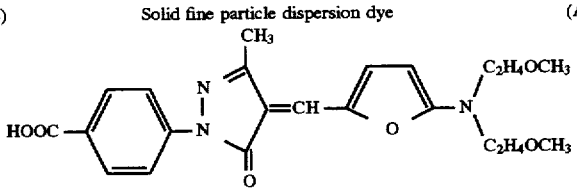

2.0

$C_8F_{17}SO_2N(C_3H_7)(CH_2CH_2O)_4—(CH_2)_4SO_3Na$ 1.0

The amount was per one side of the support, and the silver amount was 1.6 g/m$^2$ per one side of the support.

The above obtained samples were divided into two Groups A and B. The Group A samples were wedge exposed according to an ordinary method, and processed in 45 minutes using a developing machine SRX-501 (produced by Konica Corporation) with developer XD-SR (produced by Konica Corporation) and Fixer XF-SR (produced by Konica Corporation).

Sensitivity was represented by a reciprocal of exposure necessary to give a density of fog plus 0.30, and sensitivity of the samples was represented by a relative sensitivity when sensitivity of sample No. 1 is 100.

TABLE 1

| Sample No. | Compound No. | Addition amount (mg/m²) | Group A Sensitivity | Group A Fog | Group B Sensitivity | Group B Fog | Fog increment |
|---|---|---|---|---|---|---|---|
| 1 (Comparative) | HK-1 | 5 | 100 | 0.07 | 72 | 0.28 | 0.21 |
| 2 (Comparative) | HK-2 | 20 | 112 | 0.10 | 78 | 0.33 | 0.23 |
| 3 (Invention) | 1 | 20 | 107 | 0.04 | 112 | 0.07 | 0.03 |
| 4 (Invention) | 3 | 20 | 102 | 0.06 | 91 | 0.09 | 0.03 |
| 5 (Invention) | 13 | 20 | 98 | 0.06 | 90 | 0.09 | 0.03 |
| 6 (Invention) | 15 | 20 | 129 | 0.07 | 141 | 0.12 | 0.05 |
| 7 (Invention) | 20 | 20 | 94 | 0.05 | 84 | 0.07 | 0.02 |
| 8 (Invention) | 23 | 20 | 97 | 0.06 | 87 | 0.10 | 0.04 |
| 9 (Invention) | 29 | 20 | 160 | 0.12 | 84 | 0.21 | 0.09 |
| 10 (Invention) | A | 20 | 185 | 0.15 | 92 | 0.27 | 0.12 |

TABLE 2

| Sample No. | Compound No. | Addition amount (mg/m²) | Group A Sensitivity | Group A Fog | Group B Sensitivity | Group B Fog | Fog increment |
|---|---|---|---|---|---|---|---|
| 11 (Comparative) | HK-2 | 5 | 294 | 0.21 | 223 | 0.78 | 0.57 |
| 12 (Invention) | 1 | 5 | 274 | 0.17 | 291 | 0.21 | 0.04 |
| 13 (Invention) | 3 | 5 | 214 | 0.15 | 203 | 0.20 | 0.05 |
| 14 (Invention) | 13 | 5 | 261 | 0.19 | 244 | 0.24 | 0.05 |
| 15 (Invention) | 15 | 5 | 218 | 0.17 | 223 | 0.34 | 0.17 |
| 16 (Invention) | 20 | 5 | 274 | 0.16 | 256 | 0.29 | 0.13 |
| 17 (Invention) | 23 | 5 | 283 | 0.18 | 253 | 0.28 | 0.10 |
| 18 (Invention) | 29 | 5 | 340 | 0.22 | 250 | 0.41 | 0.19 |
| 19 (Invention) | A | 5 | 280 | 0.24 | 243 | 0.57 | 0.33 |

HK-1

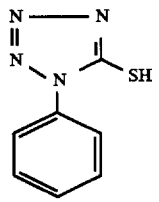

HK-2

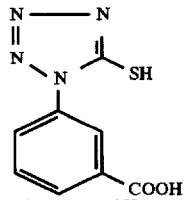

Compound A

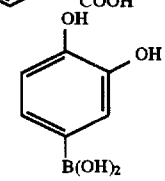

The Group B samples were stored at 55° C. and at 80% RH for 7 days, and thereafter, the resulting samples were wedge exposed and processed in the same manner as above.

The results are shown in Tables 1 and 2. In Tables 1 and 2, fog increment is a value obtained by subtracting for of Group A from fog of Group B.

As is apparent from Tables 1 and 2, when the organic compound of the invention is used, fog during the storage is markedly reduced without lowering sensitivity.

EXAMPLE 2

(Preparation of seed emulsion 2)

The seed emulsion 2 was prepared according to descriptions of Japanese Patent O.P.I. Publication No. 5-34851/

1993 and the following method, which comprised grains having two parallel twin surfaces.

(Solution A)

Ossein gelatin
80.0 g

Potassium bromide 47.4 g $HO(CH_2CH_2O)_m[CH(CH_3)CH_2O]_{19.8}(CH_2CH_2O)_nH$
(m+n=9.77, 10% methanol solution)
0.48 ml Potassium bromide
10.8 g 10% nitric acid
114 ml Water was added to make 8000.0 ml.

(Solution B)

Sodium nitrate
1200.0 g

Water was added to make 1600.0 ml.

(Solution C)

Ossein gelatin
32.2 g

Potassium bromide
790.0 g

Potassium iodide
70.34 g

Water was added to make 1600 ml.

(Solution D)

Aqueous ammonia
470.0 m

By the use of a mixing stirrer described in Japanese Patent Publication Nos. 62-160128/1987, Solutions B and C were added to Solution A with vigorous stirring in 7.7 minutes at 40° C. by a double-jet method to form a nuclei. During the process, pBr was kept at 1.60.

Thereafter, the temperature of the resulting emulsion was lowered to 20° C. in 35 minutes, and Solution D was added thereto and ripened for 20 minutes. During the ripening, the concentrations of potassium bromide and ammonia were kept at 0.03 mol/liter and 0.66 mol/liter, respectively.

After the ripening, the resulting emulsion was adjusted to pH 6.0, and desalted according to an ordinary method.

When the seed emulsion Em-2 was observed by means of an electron microscope, they had silver halide grains having an average diameter of 0.225 μm in which two parallel twin surface grains was 75% based on the total grain number.

(Preparation of Emulsion Em-2)

Emulsion Em-2 was prepared using the following five solutions.

(Solution A-1)

Ossein gelatin
66.5 g

Distilled water
3227.0 ml $HO(CH_2CH_2O)_m[CH(CH_3)CH_2O]_{1.98}(CH_2CH_2O)_nH$
(m+n=9.77, 10% methanol solution)
2.50 ml Seed emulsion 2 98.5 g Distilled water was added to make 3500.0 ml.

(Solution B-1)

3.5N Sodium nitrate solution
4702.0 ml (Solution C-1)

Potassium bromide
2499.0 g

Distilled water was added to make 6000 ml.

(Solution D-1)

Fine gain emulsion containing a 3 weight % gelatin solution and silver iodide grains having an average grain size of 0.05 μm (* Preparation of fine gain emulsion)

Two hundred milliliters of each of a 7.06 mol $AgNO_3$ solution and a 7.06 mol KI solution was added in 10 minutes to five hundred milliliters of a 6.0 weight % gelatin solution containing 0.06 mol of KI. During the fine grain formation, the temperature was 40° C. The resulting emulsion was 12.53 kg. After the grain formation the pH was adjusted to 6.0 using a sodium carbonate solution.

(Solution E-1)

Aqueous 1.75N KBr solution
a necessary amount

Solution A-1 was placed in a reaction vessel and solutions B-1 through D-1 were added with vigorous stirring according to Table 3 by a double-jet method. The seed grains were grown and a core/shell type silver halide emulsion was prepared.

Herein, the addition rates of solutions B-1, C-1 and D-1 and solutions B-1 and C-1 was varied as a function of time to meet a critical grain growing rate, and suitably controlled not to produce fine grains other than the seed grains and not to cause polydispersion due to Ostwald ripening.

During grain crystal growth, the temperature was kept at 75° C. and pAg 8.8. In order to control pAg, E-1 was optionally added with solution E-1. The pH was not controlled, but kept at 5.0 to 6.0 during the grain growth. The added silver amount at the addition time of the solutions and the silver iodide content of silver halide grains during grain growth are also shown in Table 3.

After the grain growth, the resulting emulsion was subjected to desalting according to descriptions of Japanese Patent O.P.I. Publication No. 5-72658/1993. To the resulting emulsion were added 1.19 liter of a 20 weight % aqueous gelatin solution and dispersed at 50° C. for 30 minutes. After the dispersion, the emulsion was adjusted to give pH of 5.80 and pBr of 3.55.

The resulting emulsion (Em-2) had tabular silver halide grains having an average diameter of 1.34 μm (diameter to circle according to projected area), an average aspect ratio of 2.6 and a grain size distribution breadth of 18%.

TABLE 3

| Solution to be added | Time to be added (min) | Silver amount to be added (%) | Silver iodide content (mol %) |
|---|---|---|---|
| (1) B-1, C-1, D-1 | 0.00 | 0.0 | 10.0 |
| (1) B-1, C-1, D-1 | 30.99 | 3.0 | 10.0 |
| (1) B-1, C-1, D-1 | 52.47 | 6.0 | 10.0 |
| (1) B-1, C-1, D-1 | 76.48 | 10.0 | 10.0 |
| (1) B-1, C-1, D-1 | 76.48 | 10.0 | 30.0 |
| (1) B-1, C-1, D-1 | 117.30 | 18.0 | 30.0 |
| (1) B-1, C-1, D-1 | 150.13 | 25.0 | 30.0 |
| (1) B-1, C-1, D-1 | 150.13 | 25.0 | 10.0 |
| (1) B-1, C-1, D-1 | 176.09 | 31.0 | 10.0 |
| (2) B-1, C-1 | 176.09 | 31.0 | 0.0 |
| | 209.51 | 50.0 | 0.0 |
| | 221.07 | 64.0 | 0.0 |
| | 230.68 | 80.0 | 0.0 |
| | 239.00 | 100.0 | 0.0 |

(Preparation of a silver halide photographic light sensitive material)

A subbing layer was coated on one side of a triacetylcellulose film support, and the following composition layers were coated in order on the surface of the support opposite the subbing layer. Rear side first layer Aluminazol AS-100 (aluminum oxide)
0.8 g
(produced by Nissan Chemical Co., Ltd.)

Rear side second layer

Diacetyl cellulose
100 mg

Stearic acid
10 mg

Silica fine particles (average particle size 0.2 μm)
50 mg

On the surface of a triacetyl cellulose film support provided with subbing, the following individual layers, whose composition is shown below, were formed so that color photographic light-sensitive materials (Sample Nos. 101 through 119) were formed.

With regard to a coating weight, silver halide and colloidal silver were converted to metal silver which were expressed in g/m$^2$, couplers, additives and gelatin were expressed in g/m$^2$ as an added amount, and in addition, sensitizing dyes were expressed by mol number per mol of silver halide in the same layer.

| | |
|---|---|
| First layer: Anti-halation layer | |
| Black colloidal silver | 0.15 |
| UV absorber (UV-1) | 0.20 |
| Dye (CC-1) | 0.02 |
| High boiling solvent (Oil-1) | 0.20 |
| High boiling solvent (Oil-2) | 0.20 |
| Gelatin | 1.6 |
| Second layer: Intermediate layer | 1.3 |
| Gelatin | |
| Third layer: Light-sensitive layer | |
| Silver halide emulsion Em-2 | 1.8 |
| The organic compound of the invention | Shown in Tables 4 and 5 |
| Sensitizing dye (SD-3) | $1.4 \times 10^{-4}$ |
| Sensitizing dye (SD-4) | $1.8 \times 10^{-4}$ |
| Magenta coupler (M-1) | 0.30 |
| Magenta coupler (M-2) | 0.13 |

-continued

| | |
|---|---|
| Colored magenta coupler (CM-1) | 0.04 |
| DIR compound (D-1) | 0.004 |
| High boiling solvent (Oil-2) | 0.35 |
| Gelatin | 1.0 |
| Fourth layer: First protective layer | |
| Fine particle silver bromide emulsion (average particle size was 0.08 μm) | 0.3 |
| UV absorber (UV-1) | 0.07 |
| UV absorber (UV-2) | 0.10 |
| Additive 1 (HS-1) | 0.2 |
| Additive 2 (HS-2) | 0.1 |
| High boiling solvent (Oil-1) | 0.07 |
| High boiling solvent (Oil-3) | 0.07 |
| Gelatin | 0.8 |
| Fifth layer: Second protective layer | |
| Additive 3 (HS-3) | 0.04 |
| Polysiloxane (average molecular weight was 3,000) | 0.01 |
| Methylmethacrylate:ethylmethacrylate:methacrylic acid copolymer (3:3:4 in terms of weight ratio) (Average particle size was 3 μm) | 0.02 |
| Gelatin | 0.5 |

The above compositions was further added with surfactants SA-7, SA-8 and SA-9, a viscosity adjusting agent, hardeners H-1 and H-2, stabilizing agents ST-1 and ST-2 (weight average molecular weight 10,000, and 1,100,000, respectively) and antiseptic DI-1.

Oil-1: Dioctylphthalate

Oil-2: Tricresylphosphate

Oil-3: Dibutylphthalate

SH-1: Hydantoin

SH-2: 4-Ureidohydantoin

SH-3: Sodiumsulfo di(2,2,3,3,4,4,5,5,6,6,7,7-dodecylfluoroheptyl)succinate

SA-7: Sodium tri-i-propylnaphthalene sulfonate

SA-8: Sodiumsulfo di(2-ethylhexyl)succinate

SA-9: Sodium benzene sulfonate

H-2: 1,2-bis(α-vinylsulfoylacetoamido)ethane

DI-1

(a mixture of the following components)

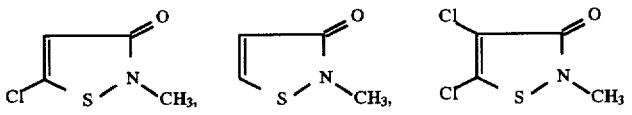

(Component A) (Component B) (Component C)

(Component A) : (Component B) : (Component C) = 50:46:4 (molar ratio)

SD-3

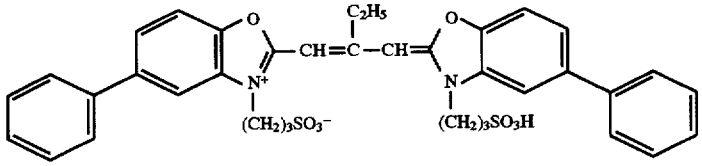

SD-4

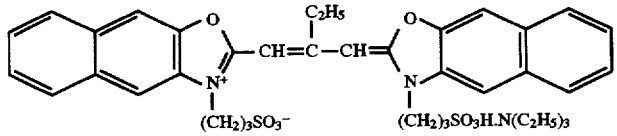

-continued
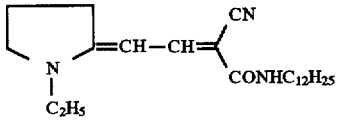
UV-2
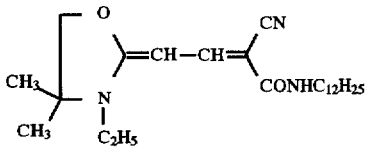
UV-2
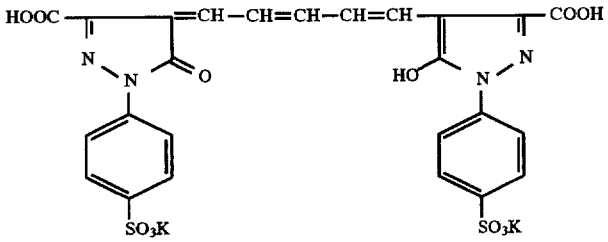
CC-1
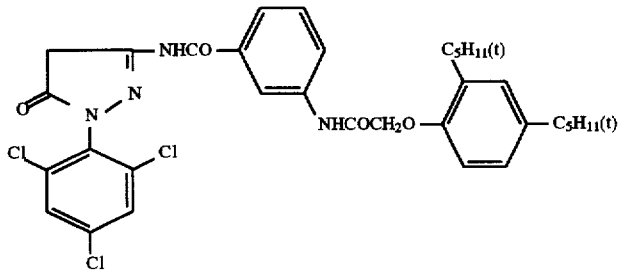
M-1
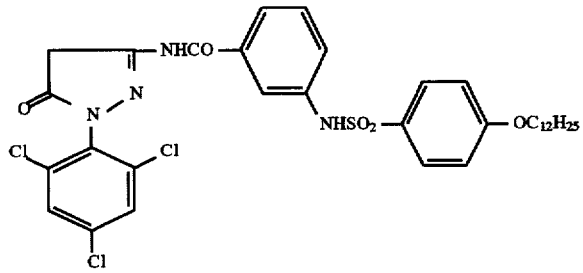
M-2
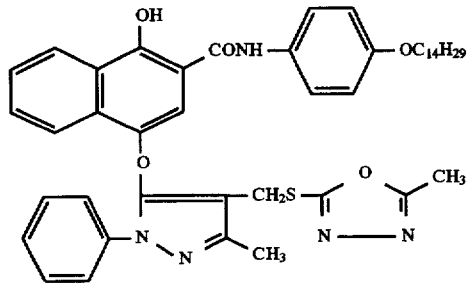
D-1

-continued

CM-1

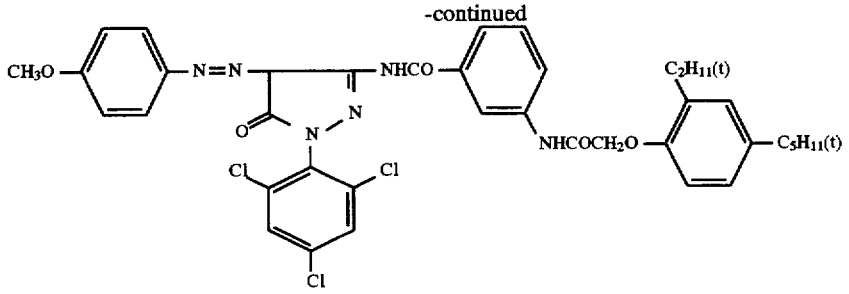

(Evaluation of photographic properties)

The above obtained sample Nos. 101 through 119 were divided into two Groups A' and B' The Group A' samples were wedge exposed according to an ordinary method, and processed according to the following processing steps.

The Group B' samples were stored at 55° C. and at 80% RH for 7 days, and thereafter, the resulting samples were wedge exposed and processed in the same manner as in Group A above.

(Photographic processing)

| Processing Step | Processing Time | Processing Temperature (°C.) | Replenishing Amount (ml) |
|---|---|---|---|
| Color developing | 3 min. 15 sec. | 38 ± 0.3 | 780 |
| Bleaching | 45 sec. | 38 ± 2.0 | 150 |
| Fixing | 1 min. 30 sec. | 38 ± 2.0 | 830 |
| Stabilizing | 60 sec. | 38 ± 5.0 | 830 |
| Drying | 1 min. | 55 ± 5.0 | — |

Incidentally, replenishing amount was expressed as a value per 1 $m^2$ of light-sensitive material.

A color developing solution, a bleaching solution, a fixing solution and their respective replenishing solutions were prepared in the following manner.

(Color developing solution and color developing replenishing solution)

| | | Replenishing Solution |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.8 g | — |
| 4-amino-3-methyl-N-ethyl-N-(β-hydroxyethyl) aniline sulfate | 4.5 g | 6.3 g |
| Potassium hydroxide | 1.2 g | 2.0 g |
| Pentaacetate diethylene triamine | 3.0 g | 3.0 g |

Water was added to make 1 liter, and pH was regulated to 10.06 by the use of potassium hydroxide or a 20% sulfuric acid solution. In addition, pH of the replenishing solution was regulated to 10.18.

(Bleaching solution and bleaching replenishing solution)

| | | Replenishing Solution |
|---|---|---|
| Water | 700 ml | 700 ml |
| Ferric (III) ammonium of 1,3-diaminopropane tetraacetic acid | 125 g | 175 g |
| Ethylenediamine tetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter, and pH was regulated to 4.4 by the use of aqueous ammonia or glacial acetic acid. In addition, pH of the replenishing solution was regulated to 4.0. (Fixing solution and fixing replenishing solution)

| | | Replenishing Solution |
|---|---|---|
| Water | 800 ml | 800 ml |
| Ammonium thiocyanate | 120 g | 1.50 g |
| Ammonium thiosulfate | 150 g | 180 g |
| Sodium sulfite | 15 g | 20 g |
| Ethylenediamine tetraacetic acid | 2 g | 2 g |

The pH was regulated to 6.5 by the use of aqueous ammonia or glacial acetic acid, and then, water was added to make 1 liter.

(Stabilizing solution and stabilizing replenishing solution)

| | |
|---|---|
| Water | 900 ml |
| Substance to which 10 mol of p-octylphenol ethyleneoxide was added | 2.0 g |
| Dimethylol urea | 0.5 g |
| Hexamethylene tetraamine | 0.2 g |
| 1,2-benzisothiazoline-3-on | 0.1 g |
| Siloxane (L-77 produced by UCC) | 0.1 g |
| Agueous ammonia | 0.5 ml |

Water was added to make 1 liter, and pH was regulated to 8.5 by the use of aqueous ammonia or a 50% sulfuric acid solution. In addition, pH of the replenishing solution was regulated to 4.0.

The density of the above processed samples were measured through an optical densitometer PDA-65 (produced by Konica Corporation). The results are shown in Tables 4 and 5. In Tables 4 and 5, fog increment is a value obtained by subtracting fog of Group A from fog of Group B.

Sensitivity was represented by a reciprocal of exposure necessary to give a density of fog plus 0.30, and sensitivity of the samples was represented by a relative sensitivity when sensitivity of sample No. 101 /A group) is 100.

TABLE 4

| Sample No. | Compound No. | Addition amount (mg/m²) | Group A Sensitivity | Group A Fog | Group B Sensitivity | Group B Fog | Fog increment |
|---|---|---|---|---|---|---|---|
| 101 (Comparative) | HK-1 | 5 | 100 | 0.09 | 82 | 0.31 | 0.22 |
| 102 (Comparative) | HK-2 | 20 | 94 | 0.09 | 75 | 0.28 | 0.19 |
| 103 (Invention) | 1 | 20 | 132 | 0.04 | 123 | 0.05 | 0.01 |
| 104 (Invention) | 3 | 20 | 123 | 0.06 | 118 | 0.08 | 0.02 |
| 105 (Invention) | 13 | 20 | 105 | 0.05 | 98 | 0.10 | 0.04 |
| 106 (Invention) | 15 | 20 | 130 | 0.07 | 118 | 0.14 | 0.07 |
| 107 (Invention) | 20 | 20 | 87 | 0.05 | 84 | 0.08 | 0.03 |
| 108 (Invention) | 23 | 20 | 97 | 0.07 | 90 | 0.14 | 0.05 |
| 109 (Invention) | 29 | 20 | 151 | 0.12 | 91 | 0.23 | 0.11 |
| 110 (Invention) | A | 20 | 134 | 0.15 | 82 | 0.32 | 0.17 |

TABLE 5

| Sample No. | Compound No. | Addition amount (mg/m²) | Group A Sensitivity | Group A Fog | Group B Sensitivity | Group B Fog | Fog increment |
|---|---|---|---|---|---|---|---|
| 111 (Comparative) | HK-2 | 5 | 281 | 0.27 | 205 | 0.52 | 0.25 |
| 112 (Invention) | 1 | 5 | 278 | 0.18 | 285 | 0.24 | 0.06 |
| 113 (Invention) | 3 | 5 | 280 | 0.17 | 261 | 0.21 | 0.04 |
| 114 (Invention) | 13 | 5 | 267 | 0.19 | 251 | 0.24 | 0.05 |
| 115 (Invention) | 15 | 5 | 254 | 0.20 | 237 | 0.29 | 0.09 |
| 116 (Invention) | 20 | 5 | 242 | 0.22 | 220 | 0.31 | 0.09 |
| 117 (Invention) | 23 | 5 | 270 | 0.16 | 259 | 0.24 | 0.08 |
| 118 (Invention) | 29 | 5 | 305 | 0.24 | 231 | 0.39 | 0.15 |
| 119 (Invention) | A | 5 | 243 | 0.30 | 205 | 0.43 | 0.13 |

As is apparent from Tables 4 and 5, when the organic compound of the invention is used, fog during the storage is markedly reduced without lowering sensitivity.

EXAMPLE 3

Color photographic light-sensitive materials (Sample Nos. 201 through 219 were prepared in the same manner as in Example 2, except that the organic compound of the invention was incorporated into the second layer (intermediate layer) instead of the third light-sensitive layer. The resulting materials were evaluated in the same manner as in Example 2.

The results are shown in Tables 6 and 7.

TABLE 6

| Sample No. | Compound No. | Addition amount (mg/m²) | Group A Sensitivity | Group A Fog | Group B Sensitivity | Group B Fog | Fog increment |
|---|---|---|---|---|---|---|---|
| 201 (Comparative) | HK-1 | 5 | 100 | 0.15 | 76 | 0.45 | 0.30 |
| 202 (Comparative) | HK-2 | 20 | 90 | 0.13 | 75 | 0.53. | 0.40 |
| 203 (Invention) | 1 | 20 | 114 | 0.09 | 108 | 0.14 | 0.05 |
| 204 (Invention) | 3 | 20 | 115 | 0.12 | 112 | 0.18 | 0.06 |
| 205 (Invention) | 13 | 20 | 98 | 0.15 | 90 | 0.21 | 0.06 |
| 206 (Invention) | 15 | 20 | 134 | 0.18 | 110 | 0.28 | 0.10 |
| 207 (Invention) | 20 | 20 | 93 | 0.12 | 84 | 0.21 | 0.09 |
| 208 (Invention) | 23 | 20 | 101 | 0.16 | 88 | 0.24 | 0.08 |
| 209 (Invention) | 29 | 20 | 134 | 0.18 | 95 | 0.32 | 0.14 |
| 210 (Invention) | A | 20 | 121 | 0.22 | 89 | 0.38 | 0.16 |

TABLE 7

| Sample No. | Compound No. | Addition amount (mg/m²) | Group A Sensitivity | Group A Fog | Group B Sensitivity | Group B Fog | Fog increment |
|---|---|---|---|---|---|---|---|
| 211 (Comparative) | HK-2 | 5 | 240 | 0.35 | 205 | 0.67 | 0.32 |
| 212 (Invention) | 1 | 5 | 225 | 0.28 | 195 | 0.64 | 0.36 |
| 213 (Invention) | 3 | 5 | 265 | 0.20 | 235 | 0.30 | 0.10 |
| 214 (Invention) | 13 | 5 | 270 | 0.18 | 240 | 0.29 | 0.11 |
| 215 (Invention) | 15 | 5 | 232 | 0.21 | 200 | 0.35 | 0.14 |
| 216 (Invention) | 20 | 5 | 238 | 0.26 | 205 | 0.38 | 0.12 |
| 217 (Invention) | 23 | 5 | 245 | 0.27 | 225 | 0.40 | 0.13 |
| 218 (Invention) | 29 | 5 | 280 | 0.32 | 245 | 0.46 | 0.14 |
| 219 (Invention) | A | 5 | 230 | 0.38 | 190 | 0.58 | 0.20 |

As is apparent from Tables 6 and 7, when the organic compound of the invention is used, fog during storage is markedly reduced without lowering sensitivity.

What is claimed is:

1. A silver halide photographic light sensitive material comprising a support and provided thereon, a light sensitive silver halide emulsion layer, wherein said light sensitive silver halide emulsion layer or another hydrophilic colloid layer contains an organic compound represented by the following formula (1):

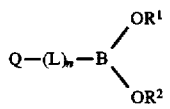

formula (1)

wherein Q represents a nitrogen-containing heterocyclic group; L represents a divalent group; $R^1$ represents a hydrogen atom or a cation; $R^2$ represents a hydrogen atom, a sodium, potassium, calcium, ammonium, trimethylammonium or pyridinium ion, an alkyl group, an alkenyl group, an alkynyl group, an aryl group, a heterocyclic group, an acyl group, a sulfonyl group, an alkoxy group or an aryloxycarbonyl group; and n is an integer of 0 or 1.

2. The silver halide photographic light sensitive material of claim 1, wherein, in formula (1), Q represents a nitrogen-containing heterocyclic ring selected from the group consisting of an imidazole ring, a pyrazole ring, a triazole ring, a tetrazole ring, an oxazole ring, a thiazole ring, a selenazole ring, a tellurazole ring, an oxadiazole ring, a thiadizole ring, a pyridine ring, a pyrazine ring, pyrimidine ring, a benzimidazole ring, a benzotriazole ring, a benzoxazole ring, a benzothiazole ring and a tetrazaindene ring; L represents an alkylene group, an arylene group, an aromatic heterocyclic group, an ether group, a thioether group, an imino group, an ester group, an amido group or a sulfonyl group; and $R^1$ represents a hydrogen atom or a sodium, potassium, calcium, ammonium, trimethylammonium or pyridinium ion.

3. The silver halide photographic light sensitive material of claim 2, wherein said nitrogen-containing heterocyclic ring has a mercapto group or its salt group as a substituent.

4. The silver halide photographic light sensitive material of claim 1, wherein the content of said organic compound is $1\times10^{-5}$ to $1\times10^{-1}$ g/m².

5. The silver halide photographic light sensitive material of claim 1, wherein said light sensitive silver halide emulsion layer contains the organic compound.

6. The silver halide photographic light sensitive material of claim 2, wherein the content of said organic compound is $1\times10^{-5}$ to $1\times10^{-1}$ g/m².

7. The silver halide photographic light sensitive material of claim 6, wherein said light sensitive silver halide emulsion layer contains the organic compound.

8. The silver halide photographic light sensitive material of claim 7, wherein said nitrogen-containing heterocyclic ring has a mercapto group or its salt group as a substituent.

* * * * *